US006593843B1

(12) United States Patent
Becker et al.

(10) Patent No.: US 6,593,843 B1
(45) Date of Patent: Jul. 15, 2003

(54) ELECTRICAL DEVICES CONTAINING CONDUCTIVE POLYMERS

(75) Inventors: Paul N. Becker, San Carlos, CA (US); Orion Jankowski, Stanford, CA (US); Cecilia A. Walsh, Minnetonka, MN (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/606,825

(22) Filed: Jun. 28, 2000

(51) Int. Cl.[7] ..... H01C 7/10
(52) U.S. Cl. ..... 338/22 R; 338/22 SD
(58) Field of Search ..... 338/22 R, 22 SD

(56) References Cited

U.S. PATENT DOCUMENTS

| | | | | |
|---|---|---|---|---|
| 3,858,144 | A | 12/1974 | Bedard et al. | 338/22 R |
| 4,237,441 | A | 12/1980 | van Konynenburg et al. | 338/22 R |
| 4,304,987 | A | 12/1981 | van Konynenburg | 219/553 |
| 4,426,633 | A | 1/1984 | Taylor | 338/25 |
| 4,482,801 | A | * 11/1984 | Habata et al. | 219/540 |
| 4,514,620 | A | 4/1985 | Cheng et al. | 219/553 |
| 4,534,889 | A | 8/1985 | van Konynenburg et al. | 252/511 |
| 4,545,926 | A | 10/1985 | Fouts et al. | 252/511 |
| 4,689,475 | A | 8/1987 | Matthiesen | 219/553 |
| 4,724,417 | A | 2/1988 | Au et al. | 338/22 R |
| 4,774,024 | A | 9/1988 | Deep et al. | 252/511 |
| 4,800,253 | A | 1/1989 | Kleiner et al. | 219/553 |
| 4,857,880 | A | 8/1989 | Au et al. | 338/22 R |
| 4,884,163 | A | 11/1989 | Deep et al. | 361/58 |
| 4,907,340 | A | 3/1990 | Fang et al. | 29/610.1 |
| 4,924,074 | A | 5/1990 | Fang et al. | 219/548 |
| 4,935,156 | A | 6/1990 | van Konynenburg | 219/553 |

(List continued on next page.)

FOREIGN PATENT DOCUMENTS

| | | | |
|---|---|---|---|
| DE | 3707494 | A | 3/1988 |
| EP | 0952590 | A | 10/1999 |
| EP | 0952591 | A | 10/1999 |
| JP | 62-113402 | | 5/1987 |
| JP | H4-18681 | | 3/1992 |
| JP | 2698995 | | 9/1997 |
| WO | WO95/34081 | | 12/1995 |
| WO | WO97/45845 | | 12/1997 |
| WO | WO99/05689 | | 2/1999 |

OTHER PUBLICATIONS

U.S. Patent Application No. 09/364,504 (Isozaki et al, filed Jul. 30, 1999).

P. deGroot and L. Deek, J. Modern Optics, 1995, vol. 42, pp. 389–401.

International Search Report for International Application No. PCT/US01/02600 dated May 11, 2001.

International Search Report for International Application No. PCT/US01/02601 dated Jul. 29, 2002.

*Primary Examiner*—Karl D. Easthom

(57) ABSTRACT

An electrical device in which an element composed of a conductive polymer composition is positioned in contact with the first surface of a metal electrode, the first surface having a center line average roughness $R_a$ and a reflection density RD, the product $R_a$ times RD being 0.5 to 1.6 $\mu$m. The conductive polymer composition preferably exhibits PTC behavior. In a second embodiment an electrical device has an element composed of a conductive polymer composition in contact with the first surface of a metal electrode produced by providing a base metal foil having an $R_a$ of at most 0.45 $\mu$m and depositing material onto the base metal foil to form a first surface having a product of $R_a$ times RD of at least 0.14 $\mu$m. Other embodiments include electrical devices with metal electrodes made by pulse plating processes, and metal electrodes made by electrodeposition under diffusion-limited conditions. The electrical devices may be circuit protection devices and have improved electrical and physical properties.

12 Claims, 1 Drawing Sheet

U.S. PATENT DOCUMENTS

| | | | | | |
|---|---|---|---|---|---|
| 5,049,850 | A | | 9/1991 | Evans et al. | 338/22 R |
| 5,250,228 | A | | 10/1993 | Baigrie et al. | 252/511 |
| 5,280,263 | A | | 1/1994 | Sugaya | 338/22 R |
| 5,286,527 | A | | 2/1994 | Blum et al. | 427/407.1 |
| 5,378,407 | A | | 1/1995 | Chandler et al. | 252/513 |
| 5,451,919 | A | | 9/1995 | Chu et al. | 338/22 R |
| 5,582,770 | A | | 12/1996 | Chu et al. | 252/511 |
| 5,691,689 | A | | 11/1997 | Smith et al. | 338/22 R |
| 5,747,147 | A | | 5/1998 | Wartenberg et al. | 428/209 |
| 5,801,612 | A | | 9/1998 | Chandler et al. | 338/22 R |
| 5,831,510 | A | | 11/1998 | Zhang et al. | 338/22 R |
| 5,852,397 | A | | 12/1998 | Chan et al. | 338/22 R |
| 5,856,773 | A | | 1/1999 | Chandler et al. | 338/22 R |
| 5,864,280 | A | | 1/1999 | Hall | 338/22 R |
| 5,864,281 | A | | 1/1999 | Zhang et al. | 338/22 R |
| 5,874,885 | A | | 2/1999 | Chandler et al. | 338/22 |
| 5,880,668 | A | | 3/1999 | Hall | 338/22 R |
| 5,908,542 | A | | 6/1999 | Lee et al. | 205/152 |
| 5,940,958 | A | | 8/1999 | Shaw, Jr. et al. | 338/22 R |
| 5,955,936 | A | * | 9/1999 | Shaw, Jr. et al. | 338/22 R |
| 6,086,743 | A | | 7/2000 | Ameen et al. | 205/183 |
| 6,104,587 | A | | 8/2000 | Banich et al. | 361/106 |
| 6,157,289 | A | * | 12/2000 | Kojima et al. | 338/22 R |
| 6,248,401 | B1 | | 6/2001 | Chiang et al. | 427/255.7 |
| 6,358,438 | B1 | | 3/2002 | Isozaki et al. | 252/511 |

* cited by examiner

ELECTRICAL DEVICES CONTAINING CONDUCTIVE POLYMERS

BACKGROUND OF THE INVENTION

1. Field of the Invention

This invention relates to electrical devices comprising conductive polymer compositions, to methods of making such devices, and to circuits comprising such devices.

2. Introduction to the Invention

Electrical devices comprising conductive polymer compositions are well known. Such devices comprise an element composed of a conductive polymer. The element is physically and electrically connected to at least one electrode suitable for attachment to a source of electrical power. The factors determining the type of electrode used include the specific application, the configuration of the device, the surface to which the device is attached, the resistance of the device, and the nature of the conductive polymer. Among those types of electrodes that have been used are solid and stranded wires, metal foils, perforated and expanded metal sheets, porous electrodes, and conductive inks and paints. When the conductive polymer element is in the form of a sheet or a laminar element, metal foil electrodes that are directly attached to the surface of the conductive polymer, sandwiching the element, are particularly preferred. Examples of such devices are found in U.S. Pat. Nos. 4,426,633 (Taylor), 4,689,475 (Matthiesen), 4,800,253 (Kleiner et al), 4,857,880 (Au et al), 4,907,340 (Fang et al), 4,924,074 (Fang et al), 5,831,510 (Zhang et al), 5,852,397 (Chan et al), 5,864,281 (Zhang et al), and 5,874,885 (Chandler et al), the disclosures of which are incorporated herein by reference.

Metal foils having microrough surfaces can give excellent results when used as electrodes in contact with conductive polymers. U.S. Pat. No. 4,689,475 discloses the use of metal foils that have surface irregularities, e.g. nodules, which protrude from the surface by 0.1 to 100 $\mu$m and have at least one dimension parallel to the surface which is at most 100 $\mu$m. U.S. Pat. No. 4,800,253 discloses the use of metal foils with a microrough surface which comprises macronodules which themselves comprise micronodules. U.S. Pat. No. 5,874,885 discloses the use of a metal electrode made of more than one type of metal with particular surface characteristics. Other documents which disclose the use of metal foils having rough surfaces, but which do not disclose the characteristics of the foils, are Japanese Patent Kokai No. 62-113402 (Murata, 1987), Japanese Patent Kokoku H4-18681 (Idemitsu Kosan, 1992), and German Patent Application No. 3707494A (Nippon Mektron Ltd., 1988). U.S. Pat. No. 5,880,668 discloses the use of a modified polyolefin with a carboxylic acid derivative grafted onto the polymer in combination with certain foils. The disclosure of each of these documents is incorporated herein by reference.

Desired properties of electrode materials for conductive polymer devices include: a low contact resistance to the polymer; a strong bond which will survive extended and repetitive electrical and/or mechanical stresses and adverse environmental conditions such as extreme temperatures, temperature cycling, heat and humidity; compatibility with conventional fabrication techniques; and low cost.

SUMMARY OF THE INVENTION

We have found that improved electroding for conductive polymers can be accomplished by using foil having a combination of surface features making up the surface roughness which is in a range lower than that previously used. Until now, the primary mechanism proposed for forming a good bond between conductive polymers and metal foils has been mechanical interlocking achieved by using a rough surface on the metal foil, wherein the surface of the foil is imbedded into the conductive polymer by heating the polymer above its melting point during the electroding process. The resulting devices can have low contact resistance and good electrical performance. However, we have found that excellent performance can be achieved by fabricating devices with metal foils that have a surface roughness parameter described by the product of two characteristic measurements of surface properties. Devices made by the present invention demonstrate low electrical resistance indicating low contact resistance at the electrode-polymer interface, resistance stability following thermal cycling, and improved resistance stability during and following prolonged and repeated electrical stress.

$R_a$ is a measure of one aspect of surface roughness known as "center line average roughness," which relates to an average value of the height of protrusions from a surface and is further described below. The measurement of the average value of height of protrusions, however, does not give any information about the density, distribution, or nature of the protrusions (e.g. spiked, rounded, etc.). A measurement of the reflection density RD of the surface (described below) gives a value which relates to the amount of light reflected from a surface using fixed incident light parameters, and thus gives a measure of the amount of structure on the surface on a size scale comparable to the wavelength of the light (i.e., visible light, around 600 nm). A shiny smooth surface will give a low reflection density, as most of the light will be reflected. The combination of $R_a$ and RD can be used to describe the surface of a foil, and it is especially useful to multiply $R_a$ by RD to describe the surface of the foil.

Foils that have lower surface roughness characteristics than those previously used can be less expensive than those with higher surface roughness. In addition, lamination of viscous or highly filled conductive polymer compositions using melt processing can be facilitated by the use of lower structure foils since it is easier to imbed features of smaller average height into the viscous compositions. For example, a faster line speed can be allowed since less time is required for the polymer to flow around and fill in a structured foil surface. In a foil which has a surface which is relatively rough, it is possible that the conductive polymer composition will not fill in completely around the features of the foil surface, resulting in trapped air pockets which disrupt the electrical continuity and provide points of failure at the interface, especially under electrical stress or environmental aging. The use of lower roughness foil with smaller protrusions can enable the effective lamination of conductive polymers at much lower temperatures, which is advantageous for some applications since it is known that some conductive polymer properties can be sensitive to thermal history. We have found that foils with submicron protrusions that are present with sufficient density can make excellent electrical and mechanical bonds with these polymers.

Additionally, an adhesion promoting layer such as a coupling agent can be used between the foil and the conductive element. The use of adhesion promoting layers in combination with foils having certain roughness characteristics is described in copending commonly assigned application Ser. No. 09/606,821 (Becker et al.), filed contemporaneously with this application, the disclosure of which is incorporated herein by reference.

In a first aspect, this invention provides an electrical device comprising (A) an element which
  (1) has first and second surfaces and
  (2) comprises a conductive polymer composition, and
(B) a first metal foil electrode which
  (1) comprises
    (a) a first surface having (i) a center line average roughness $R_a$ μm, and, (ii) a reflection density RD, the product $R_a$ times RD being 0.5 to 1.6 μm, and
    (b) a second surface, and
  (2) is positioned so that the first surface of the electrode is in contact with the conductive polymer element.

In a second aspect, this invention provides an electrical device comprising (A) an element comprising a conductive polymer composition and
(B) a first metal foil electrode which
  (1) is produced by
    (a) providing a base metal foil having a first surface having a center line average roughness $R_a$ of at most 0.45 μm, and
    (b) depositing material to provide protrusions onto the first surface of the base metal foil,
  (2) comprises
    (a) a first surface having (i) a center line average roughness $R_a$ μm and (ii) a reflection density RD, the product $R_a$ times RD being at least 0.14 μm, and
    (b) a second surface, and
  (3) is positioned so that the first surface of the electrode is in contact with the conductive polymer element.

In a third aspect, this invention provides an electrical device comprising:

(A) an element comprising a conductive polymer composition,
(B) a first metal foil electrode which comprises
  (1) a first surface which is attached to the conductive polymer element and has
    (a) a center line average roughness $R_a$ μm, and
    (b) a reflection density RD, the product $R_a$ times RD being at least 0.14 μm, and
  (2) a second surface, and
(C) a crosslinking agent positioned between the first electrode and the conductive polymer element.

In a fourth aspect, this invention provides a process for making an electrical device, said process comprising:

(A) providing an element comprising a conductive polymer composition,
(B) providing a first metal electrode having
  (1) a first surface having a center line average roughness $R_a$ and a reflection density RD such that the product $R_a$ times RD is at least 0.14 μm, and
  (2) a second surface,
(C) positioning at least one crosslinking agent between the conductive polymer and the first surface of the first metal electrode, and
(D) securing the first surface of the metal electrode to the conductive polymer element with the crosslinking agent therebetween.

In a fifth aspect, this invention provides an electrical device, the device comprising (A) an element comprising a conductive polymer composition and
(B) in contact with the element, a metal electrode comprising
  (1) a base metal foil and
  (2) first and second surfaces, said first surface comprising
    (a) protrusions having a maximum height of 1 μm and
    (b) a reflection density RD of at least 0.6.

In a sixth aspect, this invention provides an electrical device, the device comprising (A) an element comprising a conductive polymer composition and
(B) a metal electrode, the metal electrode comprising
  (1) a base metal foil,
  (2) a first surface which
    (a) comprises dendritic metal structures, and
    (b) is in contact with the element, and
  (3) a second surface.

In a seventh aspect, this invention provides an electrical circuit which comprises (1) a source of electrical power;
(2) a load; and
(3) an electrical device, e.g. a circuit protection device, of the first, second, third, fifth or sixth aspect of the invention electrically connecting the source and the load.

BRIEF DESCRIPTION OF THE DRAWINGS

The invention is illustrated in the accompanying drawings, in which.

DETAILED DESCRIPTION OF THE INVENTION

Figure 1:
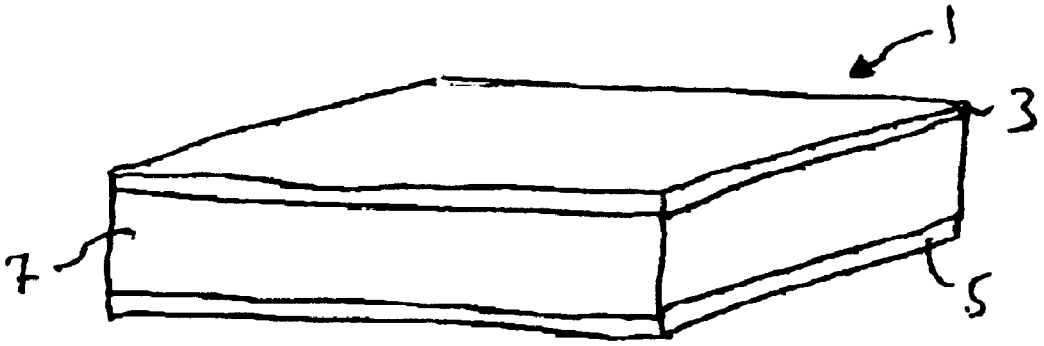
FIG. 1 shows a plan view of a device of the invention.

Electrical devices of the invention are prepared from an element composed of a conductive polymer composition. The conductive polymer composition can be one in which a particulate conductive filler is dispersed in a polymeric component or matrix. Alternatively, the conductive polymer composition can comprise an intrinsically conducting polymer, such as polyaniline. The composition can exhibit positive temperature coefficient (PTC) behavior, i.e. it shows a sharp increase in resistivity with temperature over a relatively small temperature range, although for some applications the composition may exhibit zero temperature coefficient (ZTC) behavior. In this specification, the term "PTC" is used to mean a composition or device which has an $R_{14}$ value of at least 2.5 and/or an $R_{100}$ value of at least 10, and it is preferred that the composition or device should have an $R_{30}$ value of at least 6, where $R_{14}$ is the ratio of the resistivities at the end and the beginning of a 14° C. range, $R_{100}$ is the ratio of the resistivities at the end and the beginning of a 100° C. range, and $R_{30}$ is the ratio of the resistivities at the end and the beginning of a 30° C. range. Generally the compositions used in the devices of the invention that exhibit PTC behavior show increases in resistivity which are much greater than those minimum values.

The PTC compositions used in the present invention are preferably conductive polymers that comprise a crystalline polymeric component and, dispersed in the polymeric component, a particulate filler component that comprises a conductive filler, e.g. carbon black or a metal. The filler component may also contain a non-conductive filler, which may change not only the electrical properties of the conductive polymer but also its physical and/or thermal properties. The composition can also contain one or more other components, e.g. an antioxidant, crosslinking agent, coupling agent, flame retardant, or elastomer. Suitable conductive polymers for use in this invention include those having a polymeric component which comprises polymers of one or more olefins, particularly polyethylene; copolymers of at least one olefin and at least one monomer copolymerisable therewith such as ethylene/ethyl acrylate, ethylene/acrylic acid, ethylene/vinyl acetate, and ethylene/butyl acrylate copolymers; melt-shapeable fluoropolymers such as polyvinylidene fluoride and ethylene/tetrafluoroethylene copolymers (including terpolymers); and blends of two or more such polymers. For some applications it may be desirable to blend one crystalline polymer with another polymer, e.g. an elastomer, an amorphous thermoplastic polymer, or another crystalline polymer, in order to achieve specific physical or thermal properties, e.g. flexibility or maximum exposure temperature. Electrical devices of the invention are particularly useful when the conductive polymer composition comprises a polyolefin because of the difficulty of bonding conventional metal foil electrodes to polyolefins, particularly nonpolar polyolefins. For applications in which the composition is used in a circuit protection device, it is preferred that the crystalline polymer comprise polyethylene, particularly high density polyethylene; and/or an ethylene copolymer; or a fluoropolymer. The polymeric component generally comprises 30 to 90% by volume, preferably 45 to 85% by volume, particularly 55 to 80% by volume of the total volume of the composition.

The particulate conductive filler which is dispersed in the polymeric component may be any suitable material, including carbon black, graphite, metal, metal oxide, conductive coated glass or ceramic beads, particulate conductive polymer, or a combination of these. The quantity of conductive filler needed is based on the required resistivity of the composition and the resistivity of the conductive filler itself. For many compositions, the conductive filler comprises 10 to 70% by volume, preferably 15 to 55% by volume, and particularly 20 to 45% by volume of the total volume of the composition. When used for circuit protection devices, the conductive polymer composition has a resistivity at 23° C. of less than 100 ohm-cm, preferably less than 10 ohm-cm, particularly less than 5 ohm-cm, especially less than 3 ohm-cm, e.g. 0.005 to 2 ohm-cm. The resistance at 23° C. of circuit protection devices is generally less than 100 ohms, preferably less than 10 ohms, particularly less than 1 ohm, e.g., less than 0.1 ohm. When the electrical device is a heater, the resistivity of the conductive polymer composition is generally higher, e.g. $10^2$ to $10^5$ ohm-cm, preferably $10^2$ to $10^4$ ohm-cm.

Dispersion of the conductive filler and other components may be achieved by melt processing, solvent-mixing, or any other suitable means of mixing. Following mixing the composition can be melt-shaped by any suitable method to produce the element. Suitable methods include melt-extruding, injection-molding, compression-molding, and sintering. For many applications it is desirable that the compound be extruded into sheet from which the element may be cut, diced, or otherwise removed. When the composition is melt-processed, some compositions may be very viscous, e.g. compositions made with high loading of conductive fillers or other fillers, or those made with relatively high molecular weight polymers. The specific energy consumption (SEC) of the compositions is an indication of their viscosity during processing. Useful compositions for electrical devices can exhibit a SEC in the range 0.5MJ/kg to 4 MJ/kg, preferably 0.75 to 3MJ/kg. The element may be of any shape, e.g. rectangular, square, or circular. Depending on the intended application, the composition may undergo various processing techniques, e.g. crosslinking or heat-treatment, following shaping or following attachment of electrodes. Crosslinking can be accomplished by chemical means or by irradiation, e.g. using an electron beam or a $Co^{60}$ γ-irradiation source, and may be done either before or after the attachment of the electrode.

The conductive polymer element may comprise one or more layers of a conductive polymer composition. For some applications, e.g. where it is necessary to control the location at which a hotline or hotzone corresponding to a region where high current density forms, it is desirable to prepare the element from layers of conductive polymers which have different resistivity values.

Suitable conductive polymer compositions are disclosed for example in U.S. Pat. Nos. 4,237,441 (van Konynenburg et al), 4,304,987 (van Konynenburg), 4,514,620 (Cheng et al), 4,534,889 (van Konynenburg et al), 4,545,926 (Fouts et al), 4,724,417 (Au et al), 4,774,024 (Deep et al), 4,935,156 (van Konynenburg et al), 5,049,850 (Evans et al), 5,378,407 (Chandler et al), 5,451,919 (Chu et al), 5,582,770 (Chu et al), 5,747,147 (Wartenberg et al), and 5,801,612 (Chandler et al), and U.S. patent application Ser. No. 09/364,504 (Isozaki et al, filed Jul. 30, 1999), now U.S. Pat. No. 6,358,438. The disclosure of each of these patents and applications is incorporated herein by reference.

The electrode is generally in the form of a solid metal sheet, e.g. a foil, although for some applications, the electrode may be perforated, e.g. contain holes or slits. The electrode may comprise layers of different metals, or it may comprise a base layer made of a first metal, and a surface layer made of a metal or alloy which is either the same or different from the metal of the base layer. For many applications, it is preferred that the metal foil electrodes comprise nickel or copper, and in some instances it is preferred that the surface of the electrode contacting the conductive polymer element comprise nickel. For some applications, it is preferred to use rolled metal (e.g., nickel) as a base layer. For other applications, it is preferred to use copper as a base layer, with a nickel-flashed exterior surface. For many devices of the invention, it is preferred to use two electrodes, sandwiching the conductive polymer element.

The surface of the electrode may be relatively smooth or may be microrough. Microrough surfaces generally are those which have irregularities or nodules which protrude from the surface, e.g. by a distance of at least 0.03 μm. Each irregularity or nodule may be composed of smaller nodules. Such microroughness is often produced by electrodeposition in which a metal foil is exposed to an electrolyte, or by codeposition of particulates, but a microrough surface may also be achieved by removing material from a smooth surface, e.g. by etching, by chemical reaction on a smooth surface, by reverse plating, or by contacting a smooth surface with a patterned surface, e.g. by rolling, pressing, or embossing. Metal foils with relatively smooth surfaces have been historically difficult to effectively bond to conductive polymer compositions, especially if the conductive polymer composition has a high level of filler and/or comprises a non-polar polymer. However, we have found that microrough surfaces with certain characteristics can be effectively bonded to very highly filled conductive polymer compositions to make devices with excellent electrical and mechanical characteristics.

$R_a$, the center line average roughness, is defined as the arithmetic average deviation of the absolute values of the roughness profile from the mean line or center line of a surface. The value of the center line is such that the sum of all areas of the profile above the center line is equal to the sum of all areas below the center line, when viewed at right angles to the foil. Thus $R_a$ is a gauge of the height of the protrusions from the surface of the foil. Conventionally, measurements have been made using a Tencor P-2 profilometer, available from Tencor. In this specification $R_a$ has been measured using an interferometer, a Zygo Model NewView 100, available from Zygo. The measurement of surface properties can be dependent upon the method used. In one limit, the surface roughness can be described as fractal in nature, because smaller and smaller features can be resolved with different techniques. It is also important to describe the surface area which was interrogated to insure that the entire surface is correctly represented, rather than reflecting a value which describes a local area only. For these reasons, it is important to identify and specify the best tool for characterizing the surface type of interest. Measurements made using a profilometer involve dragging a stylus across a surface and can be affected and limited by the size and shape of the stylus, and the speed with which the stylus traverses the surface. For example, the stylus may be too large to resolve cleanly the valley between peaks, particularly in cases where the foil structure includes narrow deep trenches. An interferometer is an optical instrument and can detect features over a very broad range of sizes, e.g., submicrometer to many micrometers. The use of an interferometer to measure surface characteristics is described in the article by P. deGroot and L. Deek, J. Modern Optics, 1995, vol. 42, pp. 389–401, the disclosure of which is incorporated herein by reference. For the applications described herein, where the surfaces can contain small, closely spaced, and/or irregularly shaped features, it is found that the use of an interferometer can provide more accurate measurements. Therefore, $R_a$ is defined herein as that measured by an interferometer.

Another characteristic measure of the surface roughness is obtained by measuring RD, the reflection density, which is defined as [$\log_{10}$(100%/%reflected light)], for visible light in the range 400–700 nm. Thus a highly reflective surface will have a low RD, and a surface appearing black will have a high RD. Measurements of RD can be made with a Macbeth Model RD-1232 ColorChecker™ densitometer with calibration against a black standard prior to the measurement. This instrument is designed for characterizing the reflectivity of surfaces which produce relatively few specular reflections. In order to characterize the reflectivity of surfaces exhibiting both specular and diffuse reflections, we have also used a GretagMacbeth™ Model ColorEye™ XTH spectrophotometer.

Since $R_a$ generally does not provide information about the nature or number of features on the surface of the foil, it is useful to characterize the overall surface roughness of a foil by calculating the product $R_a$ times RD (i.e., $R_a$*RD), and defining the quantity $R_a$*RD which is optimal for a bond with excellent electrical contact and mechanical strength. For instance, a foil that has features that have very low average height (i.e. low $R_a$, e.g., less than 0.5 $\mu$m) can achieve a good bond if the foil has a sufficiently high density of these features (i.e. high RD, e.g., greater than 1). Conversely, a similar foil with the same low $R_a$ may not achieve a good bond if the density of the features is not sufficiently high (RD too low, e.g., less than 0.4). For some applications, it is preferred that the product $R_a$*RD be at least 0.5 to 5 $\mu$m, preferably 0.5 to 3 $\mu$m, particularly 0.5 to 1.6 $\mu$m, especially 0.5 to 1.4$\mu$m, e.g., 0.7 to 1.4 $\mu$m. For applications in which $R_a$ times RD is 0.5 to 1.6 $\mu$m, it is preferred that the $R_a$ value is 0.3 to 4 $\mu$m with RD of at least 0.5, particularly preferred that $R_a$ is 0.4 to 3 $\mu$m with an RD of at least 0.5, and especially preferred that $R_a$ is 0.5 to 2.7 $\mu$m with an RD of at least 0.5, e.g., $R_a$ is 0.6 to 2.3 $\mu$m with an RD of at least 0.6.

Foils which are useful for aspects of this invention can be made by starting with a base foil and adding material onto a surface of the base foil, for example, by deposition. The nature of the base surface of the base foil can be an important factor in determining the foil surface's final roughness properties. For example, if the base surface is the matte side of an electrolytic foil, then $R_a$ of the base surface itself can be significant, e.g., 0.5 $\mu$m or higher. Electrolytic foils are generally made by electrodepositing metal from a solution onto a rotating metal drum. The resulting foil has two sides, a relatively smooth side adjacent to the drum (i.e. the shiny side), and a rougher exterior side (i.e. the matte side). If nodules are deposited or grown onto the matte side of an electrolytic foil, they can be very large, often up to 20 $\mu$m. The addition of small features on top of such a base surface may not produce a measurable change in the foil $R_a$, as it could be dominated by the relatively high $R_a$ of the base surface. However, if the base surface were smooth, e.g., a rolled metal having an $R_a$ of approximately 0.3 $\mu$m, or less, then the addition of small features on top of a smooth base surface could modify $R_a$ of the foil as the base surface would not dominate. For some applications, including those of the second embodiment, in which small features are deposited onto a base surface, it is often preferred to have a base foil with a base surface which has an $R_a$ of at most 0.5 $\mu$m, preferably at most 0.45 $\mu$m, more preferably of at most 0.3 $\mu$m, such that the product $R_a$*RD is at least 0.10 $\mu$m, preferably at least 0.12 $\mu$m, more preferably at least 0.14 $\mu$m, especially at least 0.17 $\mu$m, e.g., at least 0.2 $\mu$m. When $R_a$ of the base surface of the base foil is at most 0.45 $\mu$m, it is often preferred that the finished foil has a surface which has an $R_a$ which is 0.1 to 0.6 $\mu$m and an RD which is at least 0.5. For example, it is possible to produce densely spaced, extremely small protrusions on a very smooth surface such as a rolled metal surface by depositing metal or alloy onto the surface. By using a controlled deposition onto a surface, it is possible to produce a foil with small protrusions (e.g., height 0.1 to 1 $\mu$m), or a relatively narrow distribution of protrusion heights. If the surface onto which the protrusions are deposited is relatively smooth, then the maximum peak height (base foil surface feature height plus deposited protrusion height) will be small (e.g., 0.1 to 2 $\mu$m). Additional advantages to those stated above for using foils with smaller features include reduced risk of electrical shorting in thin devices, and reduced contribution to total mass from the foil nodules, which may be important in some applications, e.g. battery applications, in which the size of the device is preferably small and the weight is important.

In other aspects, the present invention includes foils which can be made by two different processes that may produce the desired foil characteristics for good electrode materials for electrical devices comprising conductive polymers. One foil which is especially useful for some applications is a foil which is a base metal foil which has metal deposits preferably having a maximum height of 2 $\mu$m and an RD of at least 0.5, particularly a maximum height of 1 $\mu$m and an RD of at least 0.6, and especially a maximum height of 0.7 $\mu$m and an RD of at least 1. A process which can make a foil having these properties utilizes pulse plating conditions at frequencies in the range 10 to 1000 Hz to form adherent submicron metal deposits on the surface of a base metal foil. The resulting foil has a very high surface area (high RD, e.g. greater than 0.5, and in many cases greater than 1). This technique avoids the formation of very large nodules that are commonly produced by conventional electroplating techniques that employ the application of a continuous direct current (DC). Pulse plating at frequencies lower than 10 Hz is not preferred because the duration of the "on" portion of the cycle is long enough to create a concentration gradient where metal ions have been depleted at the solid/liquid interface, resulting in similar conditions to DC which can produce large deposits and ultimately large nodules. For frequencies higher than 1000 Hz, the "off" portion of the cycle is insufficiently long to allow the cathode potential to fully decay, and therefore electrodeposition continues to some degree during the "off" portion, again resulting in DC-like plating conditions.

Another type of foil which is useful in some applications has densely spaced, fine, dendritic features. When used as an electrode for an electrical device, this type of foil has the advantage that it can make good electrical contact with the conductive polymer element despite the fragile nature of the surface features, evidenced by very small or negligible contributions to the total device resistance. The resistance of the polymer element (Re) can be measured independently from that of the device (Rv). For example, for anisotropic samples, a method which induces an inductance with eddy currents can be used to provide a resistance measurement of the polymer element (Re) without an electrode. An instrument capable of this type of measurement is a MicRhosense™ 6035, available from ADE Corporation. Alternatively, a direct comparison can be made to the resistances of devices made with a polymer element sandwiched between two electrodes which are made from other electrode materials which are known to make good electrical contact with conductive polymers such as conductive ink (e.g., silver paint) or conventional foil electrodes such as those disclosed in U.S. Pat. No. 4,689,475. Good electrical contact (i.e., low contact resistance) is achieved for many applications when Rv is at most 10% higher than Re. For other applications (e.g. very low resistance devices or high power devices) it is preferred that Rv is at most 5% higher than Re, preferably that Rv is at most 1% higher than Re. This type of foil can be made by a process which includes the use of electrodeposition of metal onto a base foil layer using a high cathode potential, so that the electrodeposition takes place under diffusion-limited conditions. Under steady-state diffusion-limited conditions, the metal ion concentrations are depleted at the cathode surface, resulting in plating occurring preferentially at any protruding region (e.g., a cusp). The resulting foil has a very high surface area, with dendritic metal features on the surface, and appears dusty. In conventional applications, foils made by similar processes with similar features would generally be subjected to further processing to mechanically strengthen the surface. For example, an encapsulating layer would be used. However, it is found that the foil as produced without an encapsulating layer is useful as an electrode material despite its dusty or fragile appearance.

It is known that crosslinking of a conductive polymer element can improve stability, especially when the device is repeatedly or continuously powered. However, crosslinking of devices can lead to an undesired increase in resistance. In another aspect of the invention, it is found that by applying a crosslinking agent to the interface between the polymer and electrode, crosslinking will occur selectively at that interface, thereby strengthening the bond between the electrode and polymer, without incurring the resistance increase associated with crosslinking of the bulk device. Suitable crosslinking agents include peroxides (e.g., dicumyl peroxide), azo-compounds (e.g., AIBN (2,2'-azo-bis-isobutyrylnitrile), and other radical initiators (e.g., strained ring hydrocarbons such as benzocyclobutane). The crosslinking agent can be activated subsequently to attaching the electrode to the polymer, or simultaneously with the attachment process. The crosslinking agent can be activated thermally, using radiation, ultrasound, or any other suitable technique. The application of a crosslinking agent to the interface between the electrode and the conductive polymer element is especially useful when the surface of the electrode in contact with the polymer element has an $R_a$*RD of at least 0.10 $\mu$m, preferably at least 0.12 $\mu$m, particularly at least 0.14 $\mu$m, especially at least 0.16$\mu$m, e.g., at least 0.20 $\mu$m.

Figure 2:
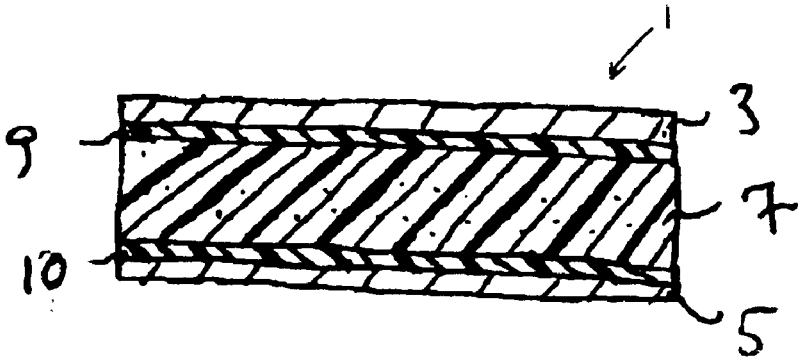
FIG. 2 shows a cross sectional view of the third aspect of the invention.

The invention is illustrated by the following drawings in which FIG. 1 shows a plan view of an electrical device 1 of the invention in which first and second metal foil electrodes 3,5, respectively, are attached directly to a PTC conductive element 7. FIG. 2 is a cross-sectional view of the third aspect of the invention. Crosslinking agents 9,10 are located between the PTC element 7 and electrodes 3,5, respectively. Although the cross-linking agents 9 and 10 are depicted as continuous layers in FIG. 2, they need not be.

The invention is further illustrated with the following examples and comparative examples.

EXAMPLES 1 to 22

Use of Low Roughness Foil to make Low Resistance Devices

A PTC conductive polymer composition was made by extruding pellets of a melt-processed conductive polymer composition containing 43% by volume carbon black (Raven™ 430, available from Columbian Chemicals) and 57% by volume high density polyethylene (Chevron 9659, available from Chevron) into sheets approximately 0.007 inch (0.18 mm) thick. Sheets were subdivided into sections. Sheets of metal foil as described in Table I were press-laminated onto the polymer sheet sections at 200° C. at approximately 150 psi (10500 g/cm$^2$) for 4 minutes to form laminated sheets approximately 0.010 inch (0.25 mm) thick.

Table I lists the base foil, the foil thickness, the $R_a$, the RD, and the $R_a$*RD for each foil. Foil A was a rolled nickel foil. Foil B was the same as Foil T, except the shiny side of the electrolytic copper foil with a nickel flash surface was bonded to the polymer. Foil C was the matte side of electrolytic nickel foil. Foil D was the shiny side of Foil V. Foil E was the shiny side of Foil C. Foils F and J were rolled Ni foils that had their surface which was in contact with the polymer etched with a ferric chloride etching solution, available from Kepro Circuit Systems. Foils G and H were rolled copper foil with a co-deposited nickel-copper nodule treatment. Foils I, K, O, Q-U, and X were electrolytic copper foils where the matte side had been flashed with nickel and subsequently followed by a nickel nodule treatment, followed by a nickel flash layer on both sides. (The matte side was bonded to the polymer.) Foils L, M, N and P were the matte side of electrolytic copper foil with copper nodule treatment, followed by a nickel flash layer on the side with nodules only. Foil V was the same as L through N, except with an additional nickel flash layer on the shiny side.

All $R_a$ values were measured using a Zygo interferometer using a typical scan area of 231 by 173 μm. The RD was measured using a MacBeth Model RD-1232 ColorChecker™ densitometer, except in the cases indicated, which were measured using a Gretag-MacBeth™ ColorEye™ XTH spectrophotometer which gave more accurate results for highly reflective surfaces. The Technical Association of the Pulp and Paper Industry (TAPPI) defines brightness as the reflectance at 45° at 457 nm. The spectrophotometer provided brightness values which were converted to RD values by use of a correlation curve. For reference, Table II shows a comparison of $R_a$ values measured by two different techniques, a surface profilometer or a Zygo interferometer, using the same samples of foil.

To measure the mechanical quality of the bond between the conductive polymer and the metal foil, peel strengths were measured on samples cut from the laminated polymer. One end of a 0.5 inch (12.7 mm) wide by 3 inch (76.2 mm) or longer sample was clamped in the jaws of an Instron 4501 testing apparatus and the foil was peeled off at a constant rate of 10 inches/minute (254 mm/minute) in a direction perpendicular to the surface of the sample. The force in pounds/linear inch required to remove the foil from the conductive polymer was recorded. Results are shown in Table I, listed in order of the product $R_a$*RD.

Individual pieces 0.25 inch (6.35 mm) in diameter were punched from the laminated sheets to form devices. As a measure of the electrical quality of the conductive polymer-metal bond, resistances were measured for the devices using a four-point probe at 23° C. to remove any extraneous contributions such as lead resistance and contact resistance to the probe. The results for the initial resistance, $R_i$, shown in Table I, are an average of ten devices. Also shown are the resistance values of devices after thermal cycling, i.e. heating the devices through twelve cycles from −40° C. to 85° C. (with a dwell time of 30 minutes at temperature and a ramp rate of 10° C./minute) before their resistances were measured at room temperature to give a final resistance, $R_f$.

TABLE I

| Ex. No. | Foil Type | Base Foil | Foil thickness (μm) | $R_a$ (μm) | RD | $R_a$*RD (μm) | Peel Strength (pli) (g/cm) | $R_i$ (ohms)[2] | $R_f$ after 12 thermal cycles (ohms) |
|---|---|---|---|---|---|---|---|---|---|
| 1 | A | rolled Ni | 25 | 0.11 | 0.30[1] | 0.03 | 0.2 (35.7) | >$10^6$ | — |
| 2 | B | shiny side, electrolytic Cu | 38 | 0.21 | 0.30[1] | 0.06 | 0.2 (35.7) | >$10^6$ | — |
| 3 | C | matte side, electrolytic Ni | 20 | 0.44 | 0.28 | 0.12 | 0.0[3] (0.0) | >$10^6$ | — |
| 4 | D | shiny side, electrolytic Cu | 39 | 0.44 | 0.30[1] | 0.13 | 0.2 (35.7) | >$10^6$ | — |
| 5 | E | shiny side, electrolytic Ni | 29 | 0.45 | 0.33[1] | 0.15 | 0.1 (17.9) | 0.133 | >$10^6$ |
| 6 | F | rolled Ni | 24 | 0.55 | 0.42[1] | 0.23 | 0.4 (71.4) | 0.028 | 0.215 |
| 7 | G | rolled Cu | 35 | 0.18 | 1.42 | 0.26 | 3.2 (571.5) | 0.018 | 0.017 |
| 8 | H | rolled Cu | 35 | 0.21 | 1.35 | 0.28 | 2.8 (500.1) | 0.018 | 0.016 |
| 9 | I | matte side, electrolytic Cu | 32 | 0.79 | 0.37 | 0.29 | 0.1 (17.9) | 0.564 | >$10^6$ |
| 10 | J | rolled Ni | 22 | 1.08 | 0.40 | 0.43 | 0.1 (17.9) | 0.023 | >$10^6$ |
| 11 | K | matte side, electrolytic Cu | 35 | 1.18 | 0.41 | 0.48 | 0.1 (17.9) | 0.023 | 0.956 |
| 12 | L | matte side, electrolytic Cu | 17 | 1.14 | 0.56 | 0.64 | 0.7 (125.0) | — | 0.015 |
| 13 | M | matte side, electrolytic Cu | 17 | 1.05 | 0.62 | 0.65 | 1.2 (214.3) | — | 0.014 |
| 14 | N | matte side, electrolytic Cu | 17 | 1.03 | 0.65 | 0.67 | 1.4 (250.0) | — | 0.014 |
| 15 | O | matte side, electrolytic Cu | 33 | 1.06 | 0.65 | 0.69 | 0.3 (53.6) | 0.019 | 0.015 |
| 16 | P | matte side, electrolytic Cu | 18 | 1.10 | 0.67 | 0.74 | 1.2 (214.3) | — | 0.015 |
| 17 | Q | matte side, electrolytic Cu | 19 | 1.34 | 0.90 | 1.21 | 3.4 (607.2) | — | 0.016 |
| 18 | R | matte side, electrolytic Cu | 33 | 1.60 | 0.90 | 1.44 | — | — | 0.015 |
| 19 | S | matte side, electrolytic Cu | 38 | 2.80 | 0.92 | 2.58 | 5.1 (910.9) | — | 0.015 |
| 20 | T | matte side, electrolytic Cu | 38 | 3.20 | 0.89 | 2.85 | 5.7 (1018.0) | — | 0.016 |
| 21 | U | matte side, electrolytic Cu | 38 | 4.00 | 0.99 | 3.96 | 6 (1071.6) | — | 0.014 |
| 22 | V | matte side, electrolytic Cu | 39 | 4.60 | 0.93 | 4.28 | 5.3 (946.6) | — | 0.013 |

[1]Indicates the measurement was made using a Gretag-MacBeth ™ ColorEye ™ XTH spectrophotometer. All others were made with the MacBeth ColorChecker ™ densitometer, model RD-1232.
[2]>$10^6$ indicates the foil delaminated from the polymer so that no further measurement could be made.
[3]Peel strength could not be directly measured due to delamination.

The results of Table I indicate that devices with $R_a$*RD values of at least 0.50 μm had low resistances following thermal cycling, even if they had relatively poor (i.e. less than 0.5 pli (89 g/cm)) peel strength.

TABLE II

| Comparison of $R_a$ measurements | | |
|---|---|---|
| Foil Type | $R_a$ (profilometer) (μm) | $R_a$ (Zygo) (μm) |
| V[1] | 1.6[2] | 4.6 |
| T[1] | 1.6[3] | 3.2 |
| W | 1.6[3] | 3.2 |
| X[1] | 1.25[4] | 2.7 |
| R | 1.1[3] | 1.6 |
| Q | 0.85[3] | 1.34 |

[1]Foils V, T, and X are identified as "N2PO", "Type 31", and "Type 28", respectively, in U.S. Pat. No. 5,874,885.
[2]Measured using a Surtronic profilometer, available from Taylor Hobson, with a 5 μm radius stylus.
[3]Measured using a SE-40D profilometer, available from Kosaka Laboratory, Ltd., with a 2 μm radius stylus.
[4]Measured using a Tencor P-2 profilometer, available from Tencor, with a 5 μm radius stylus.

EXAMPLE 23 and 24

Use of a Crosslinking Agent at the Foil-polymer Interface.

Conductive polymer sheets were prepared as in Example 1, except that the conductive polymer was made from 36% (volume) Raven 430 carbon black and 64% (volume) LB832 polyethylene, available from Equistar, and was extruded to form sheets of 0.010 inch (0.25 mm) thickness. For Example 23, a 0.9% solution of dicumyl peroxide in methanol was applied twice (sequentially) to the roughened surface of the foil, prior to lamination. Lamination of foil onto both sides of the polymer sheet was performed by hot pressing at about 150 psi (10500 g/cm$^2$) at a temperature high enough to activate the crosslinking agent (i.e. to break the peroxide bond), which was about 200° C. The foil used was type W as listed in Table II, an electrolytic nickel foil with nickel nodules on the matte side (the side bonded to the polymer), available from Fukuda Metal Foil and Powder Co., with an RD of 0.97 (MacBeth ColorChecker™ densitometer measurement) and an $R_a$ of 3.1 μm (Zygo measurement). The laminated sheets were not crosslinked further.

Individual devices were formed by punching 0.25 inch (6.35 mm) diameter disks. Each of these pieces was inserted into a metal leadframe, and was dipped into a solder bath at approximately 240° C. for 5 seconds to attach the lead frame to the device. Finally the devices were temperature cycled by heating and cooling between −40° C. and 85° C. twelve times as in Example 1. Comparative devices were prepared with no crosslinking agent (Example 24). It is believed that the selective application of the crosslinking agent to the foil/polymer interface caused the polymer to be selectively crosslinked at the interface. Two electrical tests were performed using different sets of devices for each test. The initial resistance $R_i$ for each device was measured. Devices were inserted into a circuit which had a power supply, a switch to control the power, and a resistor to control the current. Power was applied to trip the devices into the high resistance state. For the first electrical test, devices were tripped at 16V/40 A, and then held in the tripped state at 16 V for a period of 168 hours to measure the trip endurance. For the second test, devices were tripped at 16 V/40 A, held tripped for 6 seconds, and allowed to cool for at least 2 minutes. This procedure was repeated for 500 cycles to measure cycle life. After the tests were completed, power was removed from the devices, and they were allowed to cool for at least one hour before their final resistances ($R_f$) were measured. The reported resistance ratios shown in Table III were an average for 5 devices.

TABLE III

| Example No. | Crosslinking agent | Peel strength (pli) (g/cm) | Trip endurance ($R_f/R_i$) | Cycle life ($R_f/R_i$) |
|---|---|---|---|---|
| 23 | 0.9% dicumyl peroxide | 6.7 (1196.6) | 3.77 | 1.35 |
| 24 (comparative) | None | 4.5 (803.7) | 47.17 | 1.94 |

EXAMPLE 25

Pulse Plating to Prepare Microrough Electrode Foils.

One oz. (35 μm thick) electrodeposited copper foil was contacted with a dilute sulfuric acid solution (5% by volume) for two minutes, rinsed with water and then immersed in an aqueous bath at 20 to 25° C. with a pH of 2.5 to 3.0 with the following composition (all values in mole/l): nickel sulfate, 0.09; ammonium sulfate, 0.11; sodium sulfate, 0.17; sodium chloride, 0.17; boric acid, 0.20. A conformal layer of nickel was initially plated onto the matte side of the copper foil at a steady DC current density of 2.1 mA/cm$^2$ for 3 minutes. This was immediately followed by a second nickel plating step carried out using square-wave DC pulses using 11 % duty cycle at 100 Hz and a peak pulse current density of 210 mA/cm$^2$ Nickel was plated under these pulsed conditions for a total of 3 minutes. A third pulsed plating step was similarly conducted except that the frequency and duty cycle were increased to 200 Hz and 33%, respectively, and the total plating time was 10 seconds. The resulting foil was rinsed with water and dried. The foil had an RD of 1.1 and $R_a$ of 1.5 μm (Zygo measurement). Using a conductive polymer composition as described in Example 23, foil was laminated to both sides of a conductive polymer sheet as described in Example 1. The laminated conductive polymer element had a peel strength ranging from 5.0 to 6.7 pli (893 to 1196.6 g/cm).

EXAMPLES 26 and 27

Dendritic Microrough Electrode Foils.

One oz. (35 μm thick) electrolytic copper foil was contacted with a dilute sulfuric acid solution (5% by volume) for two minutes, rinsed with water and then immersed in an aqueous bath whose composition is given in Example 25. A conformal layer of nickel was initially plated onto the matte side of the copper foil at a current density of 2.1 mA/cm$^2$ (DC) for 3 minutes. This was immediately followed by a second nickel plating step at a current density of 145 mA/cm$^2$ (DC) for 1 minute. A high overpotential existed at the cathode under these conditions and insured that the electrodeposition occurred under diffusion limited conditions, thereby producing a nickel deposit whose features were fine and dendritic in shape. The resulting foil was rinsed with water and dried. The foil RD ranged from 1.5 to 1.7. The $R_a$ was 4.3 to 4.8 μm (Zygo). The large $R_a$ value reflected the long exposure under diffusion limited conditions where growth is favored at the tips. Despite the long, fragile, feathery dendritic surface, no other layers were used for stabilization. Devices were made by laminating foil to both sides of a 0.10 inch (0.25 mm) thick polymer sheet prepared as in Example 1, except that the polymer composition contained 42% by volume carbon black and 58% by volume high density polyethylene, and the laminate was crosslinked with 11 Mrad using an electron beam. Devices were punched from the laminate, had leads attached, and were thermally cycled as described in Example 23. Cycle life testing was performed as in Example 23 by repeated powering the devices at 16V/40 A for 6 seconds for 900 cycles, allowing at least 2 minutes power off between cycles. Final resistances were measured after all power had been removed. Results are shown in Table IV. Values represent the average for 10 devices. The results for a comparative example using conventional foil (Foil T as in Example 20) are also shown. Devices of the invention, using foil prepared as above, in resistance by only 10%, whereas those made with conventional foil increased in by 69%.

TABLE IV

| Example No. | Foil RD | Foil $R_a$ ($\mu$m) | Cycle life ($R_F/R_i$) | Peel strength (pli) (g/cm) |
|---|---|---|---|---|
| 26 | 1.5–1.7 | 4.3–4.8 | 1.10 | 2.8 (500.1) |
| 27 (comparative) | 0.9 | 3.2 | 1.69 | 5.7 (1018.0) |

It will be understood that the above-described arrangements of devices and the methods described are merely illustrative of applications of the principles or this invention and many other embodiments and modifications may be made without departing from the spirit and scope of the invention as defined in the claims.

What is claimed is:

1. An electrical device comprising (A) an element comprising a conductive polymer composition, (B) a first metal foil electrode which comprises (1) a first surface which is attached to the conductive polymer element and has (a) a center line average roughness $R_a$ $\mu$m, and (b) a reflection density RD, the product $R_a$ times RD being at least 0.14 $\mu$m, and (2) a second surface, and (C) a crosslinking agent in the form of a layer positioned between the first electrode and the conductive polymer element.

2. A device according to claim 1, wherein the conductive polymer composition exhibits PTC behavior.

3. A device according to claim 1, wherein the crosslinking agent comprises dicumyl peroxide.

4. A device according to claim 1 wherein the conductive polymer composition comprises a polymeric, component and dispersed therein a particulate conductive filler.

5. A device according to claim 4 wherein the polymeric component of the composition comprises a polyolefin or a fluoropolymer.

6. A device according to claim 1 wherein the first metal foil electrode comprises nickel or copper.

7. A device according to claim 1, wherein the first surface of the first metal foil electrode comprises nickel.

8. A device according to claim 1, further comprising a second metal foil electrode positioned so that the conductive polymer element is sandwiched between the first metal foil electrode and the second metal foil electrode.

9. A device according to claim 1, wherein the crosslinking agent comprises an azo-compound.

10. A device according to claim 9, wherein the azo-compound comprises 2,2'-azo-bis-isobutyrylnitrile.

11. A device according to claim 1, wherein the crosslinking agent comprises a strained ring hydrocarbon.

12. A device according to claim 11, wherein the hydrocarbon comprises benzocyclobutane.

* * * * *